US012330754B2

(12) United States Patent
Tornheim et al.

(10) Patent No.: US 12,330,754 B2
(45) Date of Patent: Jun. 17, 2025

(54) WATER SHOES FOR WALKING, FLOATING AND JET SKIING ON WATER

(71) Applicant: Pinchas Tornheim, Paterson, NJ (US)

(72) Inventors: Pinchas Tornheim, Paterson, NJ (US); Natalie Schulman, Teaneck, NJ (US)

(73) Assignee: Pinchas Tornheim, Stony Point, NY (US)

( * ) Notice: Subject to any disclaimer, the term of this patent is extended or adjusted under 35 U.S.C. 154(b) by 387 days.

(21) Appl. No.: 17/835,283

(22) Filed: Jun. 8, 2022

(65) Prior Publication Data

US 2023/0135123 A1 May 4, 2023

Related U.S. Application Data

(60) Provisional application No. 63/272,745, filed on Oct. 28, 2021.

(51) Int. Cl.

| | |
|---|---|
| ***B63B 32/30*** | (2020.01) |
| ***B63B 39/04*** | (2006.01) |
| ***B63H 11/00*** | (2006.01) |
| ***B63H 11/107*** | (2006.01) |
| ***B63H 25/46*** | (2006.01) |

(52) U.S. Cl.

CPC ..... *B63B 32/30* (2020.02); *B63B 39/04* (2013.01); *B63H 11/107* (2013.01); *B63H 25/46* (2013.01); *B63H 2011/008* (2013.01)

(58) Field of Classification Search

CPC ..... B63B 34/00; B63B 34/40; B63B 34/45; B63B 34/56; B63B 32/00; B63B 32/30; B63B 39/04; B63B 39/08; B63H 11/107; B63H 2011/008; B63H 25/46

USPC ..... 441/65, 76, 79

See application file for complete search history.

(56) References Cited

U.S. PATENT DOCUMENTS 1,611,634 A * 12/1926 Severo ..... B63B 34/56 440/32
2,651,790 A 9/1953 Geiger
3,112,504 A * 12/1963 Carlton ..... B63B 34/56 441/77

(Continued)

FOREIGN PATENT DOCUMENTS

CN 111137430 A 5/2020
DE 19503087 A1 8/1996

(Continued)

*Primary Examiner* — Daniel V Venne
(74) *Attorney, Agent, or Firm* — Shlomo Horowitz; Shlomo Horowitz, Patents and Intellectual Property Ltd.

(57) ABSTRACT

A wearable water shoe apparatus for walking, standing and jet siding on water, includes in each of a first water shoe and a second water shoe (i) a sleeve to receive a leg of a user and (ii) a bottom section. The sleeve has a platform for standing thereon. Each pair of a plurality of pairs of jet motors is configured to eject a jet stream of water. A stabilization unit, including a tilt sensor and a plurality of gyroscopes, is configured to detect a stabilization state of at least one of the first water shoe and second water shoe. A processing unit is configured to receive output from the stabilization unit, determine a direction of movement indicated by the user and direct at least one of the pairs of motors to eject a water stream out of at least one of the water shoes based on the indicated direction.

19 Claims, 14 Drawing Sheets

(56) References Cited

U.S. PATENT DOCUMENTS

| | | | | |
|---|---|---|---|---|
| 3,808,622 | A * | 5/1974 | Webster | B63B 34/56<br>441/77 |
| 5,906,521 | A | 5/1999 | Tippmann | |
| 6,939,187 | B1 | 9/2005 | Borroto | |
| 8,608,524 | B2 | 12/2013 | Jeong | |
| 2012/0302116 | A1 | 11/2012 | Chester | |
| 2020/0121991 | A1 | 4/2020 | Emadikotak | |

FOREIGN PATENT DOCUMENTS

| | | | |
|---|---|---|---|
| DE | 202007010156 | | 2/2008 |
| FR | 3024119 | A1 | 1/2016 |
| WO | WO 2011083179 | | 7/2011 |

* cited by examiner

WATER SHOES FOR WALKING, FLOATING AND JET SKIING ON WATER

FIELD AND BACKGROUND OF THE INVENTION

The invention is in the field of water footwear and in particular water shoes configured to allow the wearer to walk or float on the water and to jet ski on the water.

It would be useful to be able for individuals to be able to walk and jet ski on water without a watercraft. This has value for practical reasons and for amusement purposes.

SUMMARY OF THE INVENTION

One embodiment is a wearable water shoe apparatus for walking, standing and jet skiing on water, comprising each of a first water shoe and a second water shoe comprising: (i) a sleeve configured to receive a leg of a user and (ii) a bottom section integrally attached to the sleeve, the sleeve having a platform for standing thereon, a processing unit, a plurality of pairs of jet motors, each of the pairs situated at different positions along an outer surface of either the bottom section or the sleeve, a stabilization unit comprising a tilt sensor and a plurality of gyroscopes, the stabilization unit configured to detect a stabilization state for the respective first water shoe or second water shoe, the processing unit configured to receive an output from the stabilization unit, determine a direction of movement indicated by the user and direct at least one of the pairs of motors to eject a water stream out of at least one of the water shoes based on the indicated direction.

In some embodiments, for the first water shoe, each of the plurality of pairs of jet motors includes a first jet motor configured to draw a stream of water into the first water shoe and thrust the drawn stream of water toward a second jet motor, working in tandem with the first jet motor, the second jet motor configured to eject the drawn stream of water out of the first water shoe.

In some embodiments, each of the plurality of pairs of jet motors in the water shoe include a first jet motor configured to rotate in a first direction so as to draw a stream of water into the first water shoe and a second jet motor configured to eject the stream of water from the first water shoe, the first jet motor and the second jet motor of each pair situated at parallel positions along an outer surface of either the bottom section or the sleeve of the first water shoe.

In some embodiments, for each water shoe, the bottom section has at least three pairs of jet motors and the sleeve has at least one pair of jet motors.

In some embodiments, wherein, for each water shoe, the bottom section has at least two pairs of jet motors and the sleeve has at least one pair of jet motors.

In some embodiments, the sleeve has at least one of the plurality of pairs of jet motors situated above the platform.

In some embodiments, the platform is disposed within the sleeve substantially horizontally and is offset vertically from the bottom section.

In some embodiments, the apparatus further comprises at least one sensor for detecting a water depth of the shoe and for sending a signal to the processing unit.

In some embodiments, at least part of the bottom section includes a buoyant material.

In some embodiments, the stabilization state includes an angle that the first water shoe or second water shoe makes with a surface of the water.

In some embodiments, the plurality of gyroscopes includes at least five gyroscopes configured to correct the stabilization state more than twenty times per second.

In some embodiments, each water shoe of the apparatus further comprises acceleration sensors.

In some embodiments, each of the water shoes is configured to be worn by a user simultaneously such that a movement of legs of the user triggers movement of the water shoes in the indicated direction without use of a watercraft separate from the water shoe apparatus.

In some embodiments, the processing unit is configured to direct, the at least one of the pairs of motors to eject the water stream in response to the user's adjustment of a pitch of at least one of the first water shoe and the second water shoe.

In some embodiments, a user leaning forward to cause a forward tilt of the first water shoe and the second water shoe triggers a forward movement of the first and second water shoes by ejecting water stream rearward and downward, and wherein leaning backward so as to cause a rearward tilt of the first water shoe and the second water shoe triggers a rearward movement of the first and second water shoes by ejecting water stream forward and downward.

In some embodiments, a forward tilt of the first water shoe on the left foot of the user without the user moving the second water shoe triggers a rightward turn of the water shoe apparatus and wherein a forward tilt of the second water shoe on the right foot of the user without the user moving the first water shoe triggers a leftward turn of the water shoe apparatus.

In some embodiments, leftward movement of the user is triggered by tilting the platform/pedal leftward which signals the processing unit to direct at least one pair of motors to eject water streams rightward.

In some embodiments, rightward movement of the user is triggered by tilting the platform/pedal rightward which signals the processing unit to direct at least one pair of motors to eject water streams leftward.

In some embodiments, the apparatus further comprises a switch accessible to the user for turning off the stabilization unit for use of the apparatus in a scuba diving mode.

These and other features, aspects and advantages will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 1A:
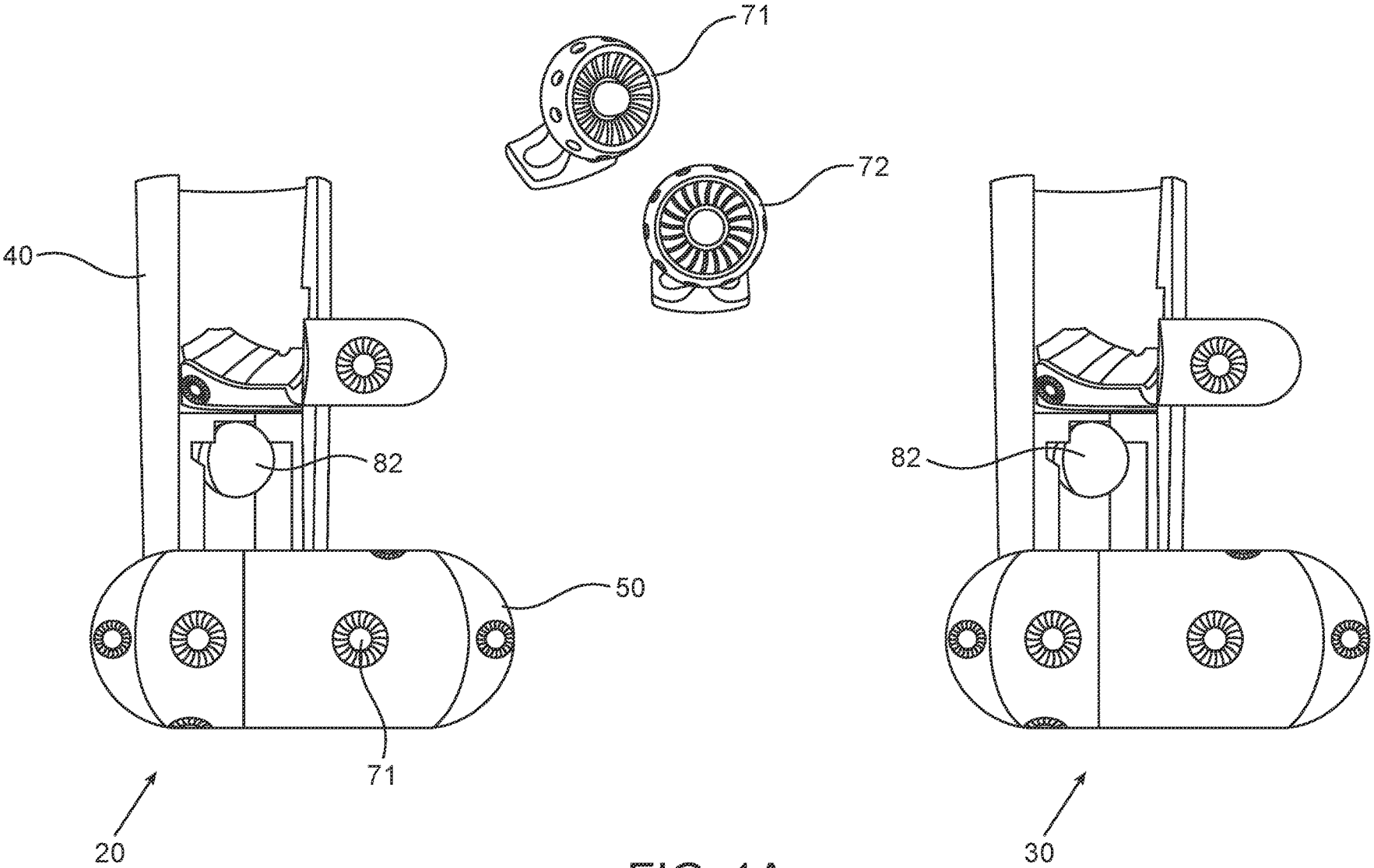
FIG. 1A is a side view of a pair of water shoes with the vertical sleeve cut open, in accordance with one embodiment.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The embodiments generally provide a water shoe apparatus comprising a pair of water shoes, one for each leg of a user, so that the user can wear the water shoes in the water (including for example a lake or an ocean) and then walk or go forward, backward, jet ski or even stand still. In some embodiments, the user moves in a way that feels like he or she is walking on the ground. The wearable water shoe apparatus for walking, standing and jet skiing on water, comprises a first water shoe and a second water shoe each of which comprises (i) a sleeve configured to receive a leg of a user for use in a standing position and (ii) a bottom section integrally attached to the sleeve. The sleeve may have a platform for standing thereon. A processing unit interacts with a jet stream mechanism that has a plurality of pairs of jet motors, for example in some embodiments a plurality of a pairs of jet motors so as to eject a jet stream of water on the outer surface of the bottom section of the shoe or on the outer surface of the sleeve of the water shoe. In some embodiments, one or more of the pairs of jet motors is situated in the sleeve and one or more of the pairs of jet motors is situated in the bottom section. A tilt sensor and a plurality of gyroscopes together form a stabilization unit that is configured to detect a stabilization state of at least one of the first water shoe and second water shoe. In some embodiments, the stabilization state includes an angle/tilt of the shoe. The processing unit is configured to receive output from the stabilization unit, determine a direction of movement indicated by the user and to direct at least one of the pairs of motors to eject a water stream out of at least one of the water shoes based on the indicated direction. The processing unit of each shoe may also be configured to stabilize the water shoe(s) independent of any directional movement of the water shoe(s).

Each of the water shoes may be configured to be worn by the user simultaneously such that a movement of legs of the user triggers movement of the water shoes in the indicated direction without use of a watercraft separate from the water shoe apparatus.

The principles and operation of Water Shoes for Walking, Floating and Jet Skiing on Water may be better understood with reference to the drawings and the accompanying description.

As seen from FIG. 1A to FIG. 10, in one embodiment, a wearable water shoe apparatus 10 for walking, standing and jet skiing on water, comprises a first water shoe 20 and a second water shoe 30. For convenience, the first water shoe 20 is deemed to be for the left foot of the user and the second water shoe 30 is deemed to be for the right foot.

Each of the first water shoe 20 and second water shoe 30 may include (i) a sleeve 40 configured to receive a leg of a user and (ii) a bottom section 50 integrally attached to the sleeve 40. The sleeve 40 may have a platform 42 or pedal 42 for the user to stand on. In some versions, bottom section 50 is shaped generally like a large shoe.

Each water shoe 20, 30 may include a plurality of pairs of jet motors, each of the pairs 70 including a first jet motor 71 configured to draw in a jet stream of water and a second jet motor 72 configured to eject the stream of water, the first jet motor and the second jet motor of each pair situated at different positions along an outer surface of either the bottom section 50 or the sleeve 40. Each pair of jet motors 70 in the plurality of pairs of jet motors 71, 72 is therefore configured to eject a jet stream of water from the water shoe 20, 30. At least one of the pairs of motors 70 may be situated in the sleeve 40 and at least one of the pairs of motors 70 may be situated in the bottom section 50. In some versions, there are many pairs of motors, for example located in the bottom section 50 and/or located in the sleeve 40. Typically, there are more pairs of jet motors in the bottom section 50 than in the sleeve 40.

For the first water shoe 20 each of the pairs of jet motors 71, 72 includes a first jet motor 71 that draws a stream of water into the first water shoe 30 and from there the drawn stream of water is thrust toward the second jet motor 72, working in tandem with the first jet motor 71. The second jet motor 72 then ejects or thrusts the drawn stream of water out of the first water shoe 20. For the second water shoe 30 each of the pairs of jet motors 71, 72 includes a first jet motor 71 that draws a stream of water into the second water shoe 30 and from there the drawn stream of water is thrust toward the second jet motor 72, working in tandem with the first jet motor 71. The second jet motor 72 in the second water shoe 30 then thrusts the drawn stream of water out of the second water shoe 20. The first jet motor 71 and the second jet motor 72 are able to work in tandem because each operates in a different direction—that is, each has a rotating shaft that rotates in a direction opposite to the rotating shall of the other jet motor.

Water shoe apparatus 10 may further comprise a tilt sensor 82 and a plurality of gyroscopes 84 in each water shoe 20, 30 that together form a stabilization unit 80 for that water shoe 20, 30. The stabilization unit 80 may be configured to detect a stabilization state of the respective first water shoe 20 or second water shoe 30 that unit 80 is in. The stabilization state may include the angle that the water shoe makes with the surface of the water or how tilted it is. Tilt sensor 82 or gyroscopes 84 or both may communicate with the processing unit 90.

Tilt sensor 82 may pass data as to the angle or tilt or orientation of the shoe 20, 30 to the gyroscope 84 or plurality of gyroscopes 84. The data from the gyroscopes 84 may be passed to the processing unit 90 that controls movement. The processing unit 90 may use data from gyroscopes 84 (and/or from other sensors including the tilt sensor 82) to determine and control several parameters including what direction the user has indicated he or she wants to go in, which jet streams, if any, to activate in order to move in an indicated direction or to stabilize the water shoe 20, 30 and what should be the RPM of the rotary element of the jet motor, for example an impeller, that forms part of the jet stream mechanism. The RPM of the rotary element may determine the speed of the water thrust out of nozzles 74, which in turn may determine the speed of movement of the water shoes 20, 30. Accordingly, processing unit 90 directs and controls the speed and direction of the water streams being ejected and in general of the water shoes 20, 30.

The gyroscopes 84 have an associated interface 84A comprising the necessary hardware and software needed to determine the orientation and balance of the shoe so as to measure how much rotation the water shoe 20, 30 has undergone relative to the balanced or level position of water shoe 20, 30, and to send corrective instructions to the communication protocols, for example the amount of correction needed to reach a level position. Using these interfaces 84A allows for an easy connection to the CPU 90. The gyroscopes 84 may be utilized if for example processing unit 90 directs the jet streams to eject water streams to adjust or correct the orientation of the water shoe 20, 30. In some implementations, water shoe 20, 30 may have a plurality of gyroscopes 84, which may include for example at least five gyroscopes configured to correct the stabilization state, for example the angle or orientation, of one or more water shoes 20, 30 many times per second. In some implementations, this stabilization state (angle, orientation etc.) may be assessed and adjusted more than twenty times per second, or in other implementations more than 50 times per second or 100 or more times per second. In some embodiments, the pedal or platform 42 that the user stands on may have a gyroscopic sensor underneath it, as seen in FIGS. 1A-11.

Processing unit 90 in each water shoe 20, 30 may be configured to receive an output from the stabilization unit 80, determine a direction of movement indicated by the user and direct at least one of the pairs of motors to eject a water stream out of at least one of the water shoes based on the indicated direction. In some embodiments, the processing unit 90 in each particular water shoe 20, 30 is able to communicate with the processing unit 90 in the other particular water shoe 20, 30 of the water shoe apparatus 10, for example by short range communication protocol that work underwater, such as BlueTooth®.

Figure 1B:
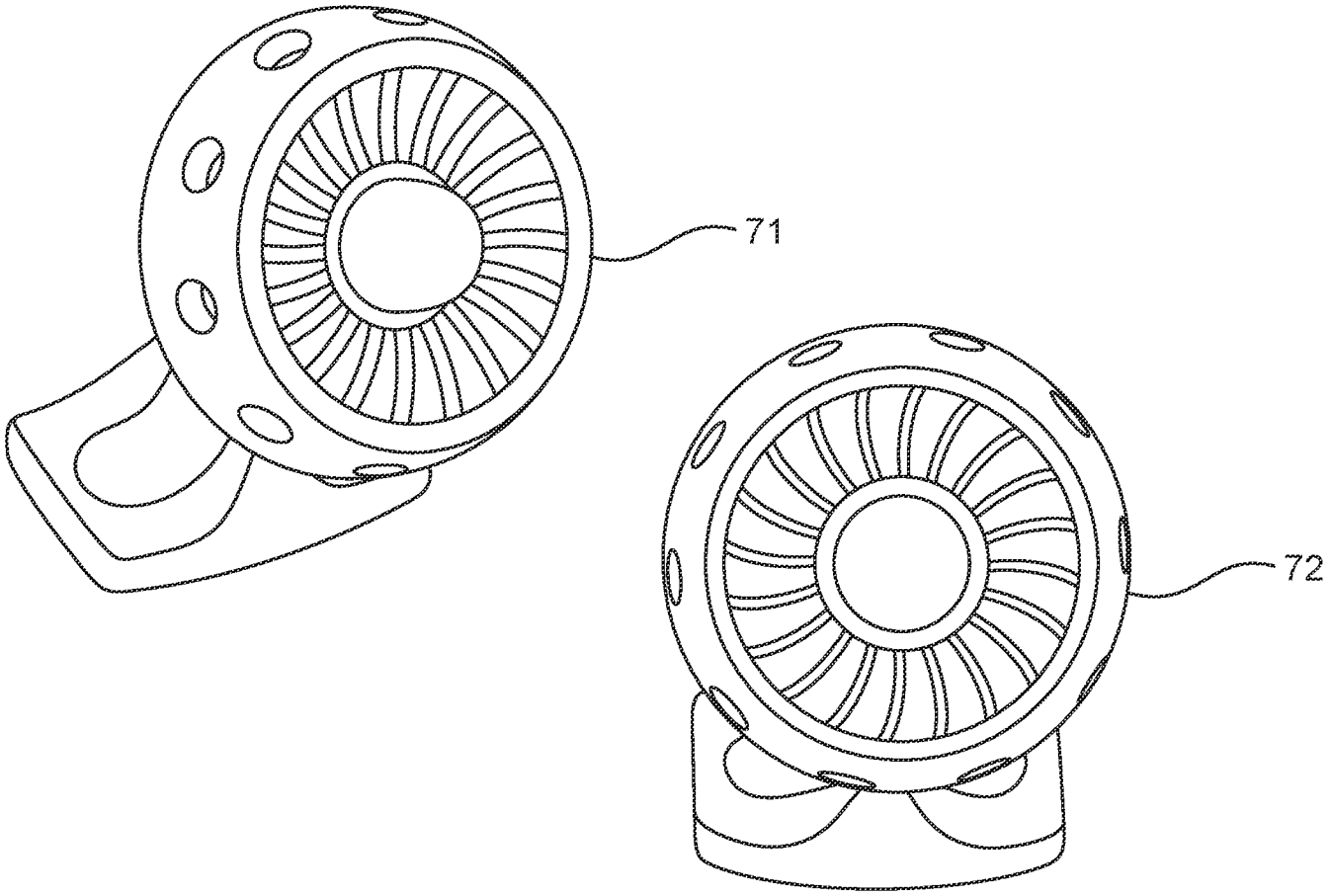
FIG. 1B is a front and side view of a first jet motor and a rear view of a second jet motor, in accordance with one embodiment.

As seen from FIG. 1, first water shoe 20 includes a pair of jet motors 71, 72 that is utilized to eject jet streams of water from first water shoe 20. A first jet motor 71 draws water into the water shoe 20 and a second jet motor 72, in one example positioned on an opposite side of the water shoe 20 from first jet motor 71, thrusts water out of the first water shoe 20. Each motor 71, 72 of each pair of jet motors 71, 72 work together in tandem.

Similarly, second water shoe 30 includes a first jet motor 71 that draws water into the second water shoe and may include a second jet motor 72 located in a different (for example parallel) position on the outer surface 52 of the water shoe 30—for example on the outer surface 52 of the bottom section 50 of the water shoe 30—that thrusts water out of the second water shoe 30.

Each jet motor 70 in apparatus 10 may be battery-powered, for example using a battery pack that typically includes a 36V 4400 mAH battery. In some embodiments, the water shoe 20, 30, together with the battery, may weigh approximately 18-20 pounds.

Figure 6:
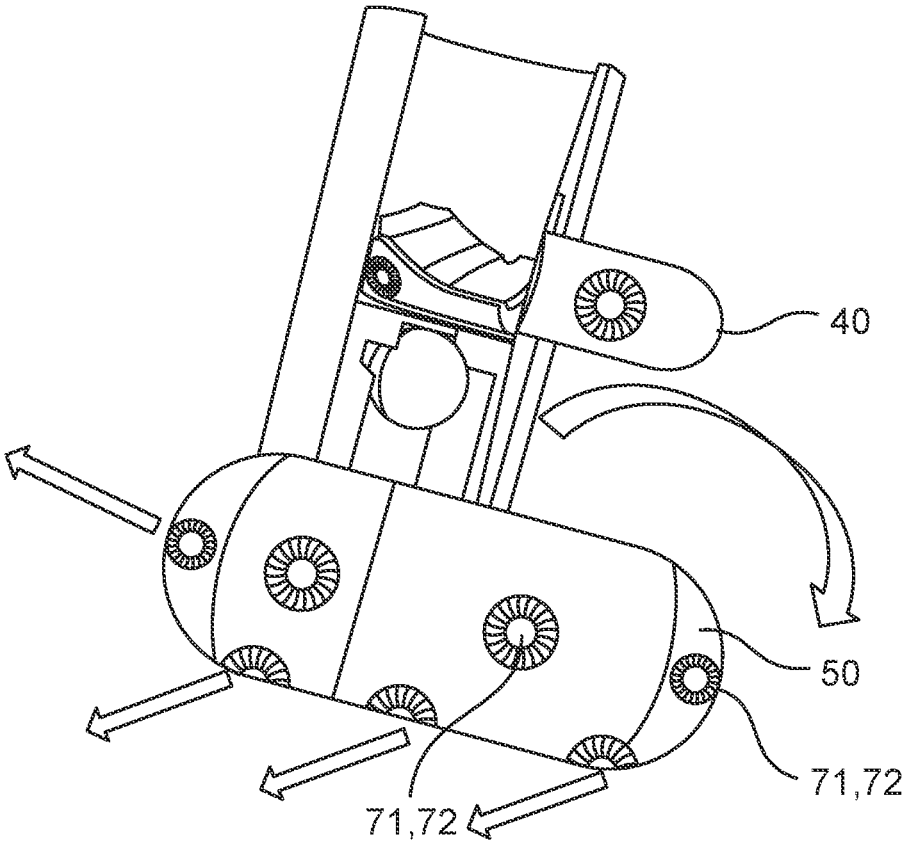
FIG. 6 is a side view of a water shoe depicting the direction of jet streams in the bottom section of the water shoe creating a rearward thrust of water using jet motors, in accordance with one embodiment.

The direction that the water stream is ejected is determined by the location of the jet motor, for example its position along an outer wall or outer surface 52 of water shoe 20, 30 and the orientation of the motor. As shown in FIGS. 1A-11, for example, the bottom section 30 may have more pairs of jet motors than the sleeve 40. For example, as seen in FIG. 6, bottom section 30 has seven motors that are visible and each of these seven jet motors may be paired with a parallel jet motor (not shown).

In one non-limiting implementation of the jet stream mechanism utilizing a pair of motors, the mechanism for transferring the water drawn into water shoe 20, 30 first the first jet motor in the pair of jet motors to the jet motor of the pair that actually ejects the water, may include certain components used in a centrifugal pump 75 such as a volute chamber (not shown). For example, the motor 71 rotates a shaft that is coupled or that is a shaft of an impeller 76 of the centrifugal pump 75. The blades of one jet motor used to draw water into the water shoe may be operatively connected to the volute chamber or another channel between one jet motor and the second jet motor of the pair 71, 72. Each of the blades 77 of the impeller of jet motor 71, 72 is configured to contact the water moving past it at the same angle and speed so that the thrust produced is evenly distributed throughout the jet stream mechanism (including in the channels connecting one motor 71 of the pair 71, 72 of jet motors to the second motor 72 of the pair 71, 72.

In one embodiment, for each water shoe 20, 30 the bottom section 50 has at least two pairs, and in other version at least three pairs of jet motors 71, 72 and the sleeve 40 has at least one pair of jet motors 71, 72.

Figure 9:
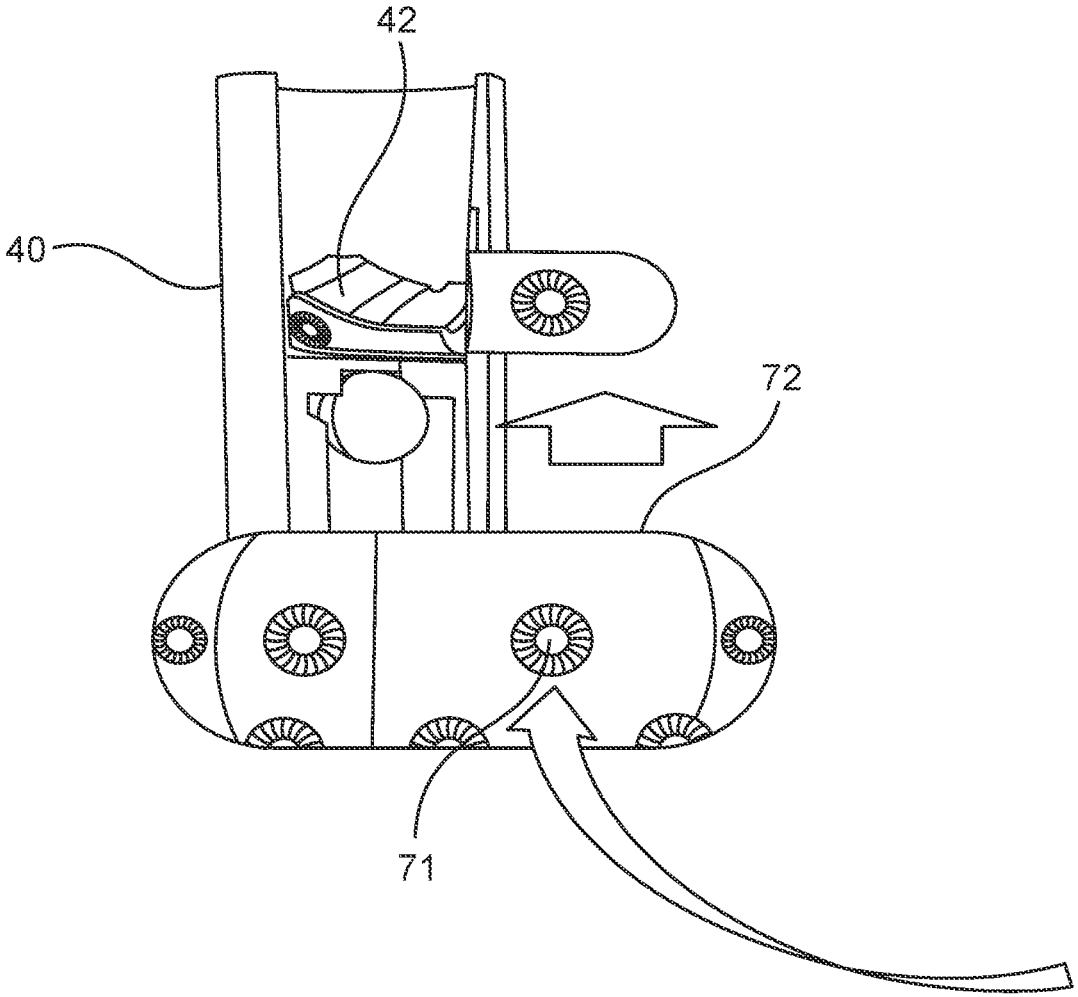
FIG. 9 is a side view of a water shoe depicting water being drawn into the water shoe at one position along the bottom section of the water shoe and water being ejected from the water shoe at another position along the bottom section of the water shoe, in accordance with one embodiment.
Figure 10:
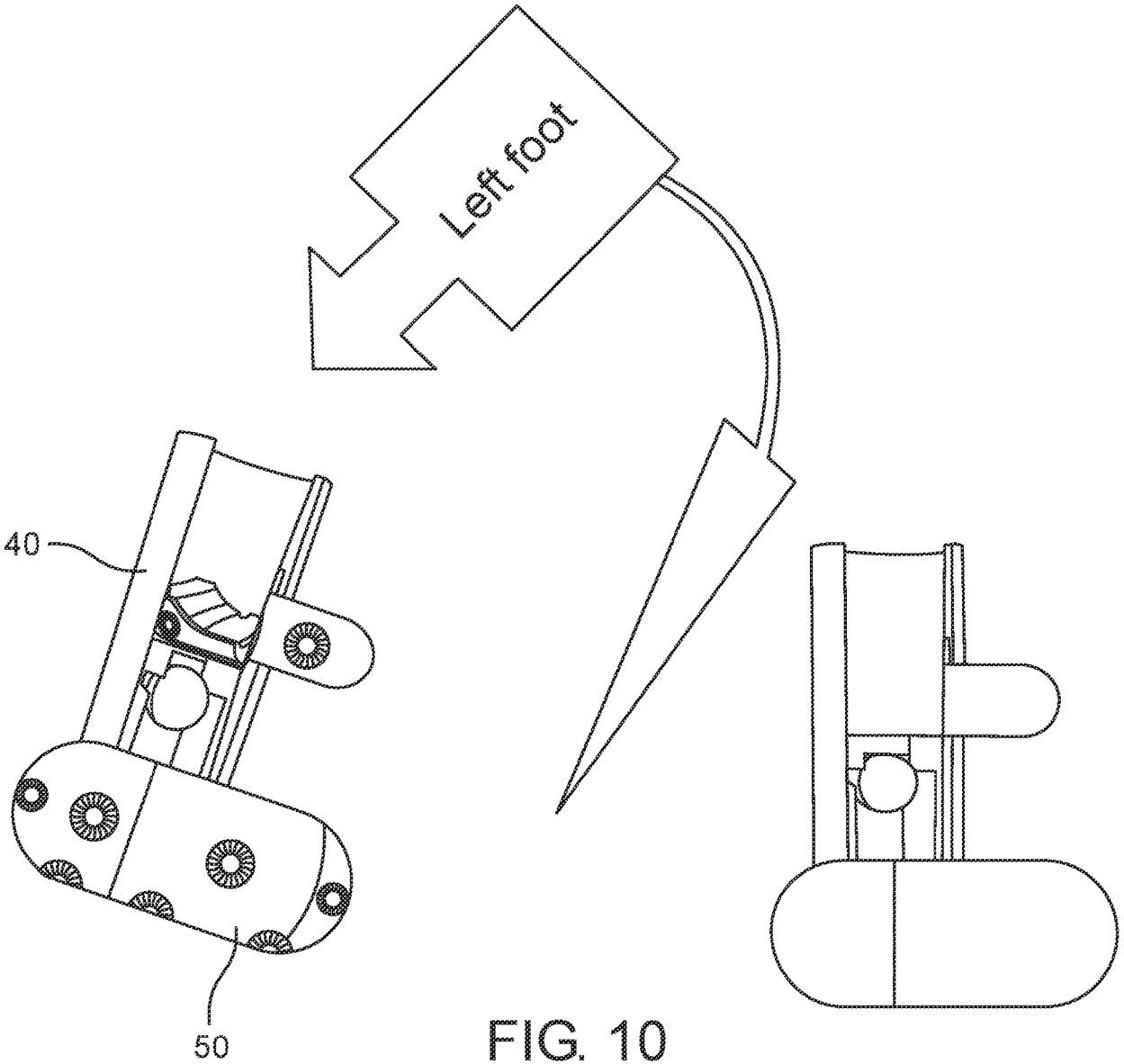
FIG. 10 is a side view of a left water shoe being tilted forward to make a right turn, in accordance with one embodiment.

For example, in one implementation there are about six to eight jet motors 70 that run on an electric battery in each water shoe 20, 30. In this case, every two jet motors are always operating in tandem and may be situated in parallel positions to each other, for example each one on an opposite side of the water shoe 20, 30 as shown in FIG. 9. Every pair of jet motors 71, 72 that are parallel to each other interact with each other. When one jet motor 71 of the pair of motors 71, 72 is configured to rotate forward the other jet motor 72 of the pair of jet motors is configured to rotate in reverse direction. Each jet motor 71, 72 can be driven in a forward or reverse motion since the output of the jet motor is a rotating shaft that turns in a forward direction or in a reverse direction. Accordingly, when the shaft of the first jet motor 71 rotates in the opposite or reverse direction, the blades of the impeller of the first jet motor 71 shoot water out of water shoe 20, 30. When the shaft of motor 71 rotates in the reverse direction, though, the shaft of second jet motor 72 rotates in the forward direction and draws in water (from a location for example opposite that of the first jet motor 71) and sends that water in a jet stream toward the first jet motor 71.

Accordingly, in this embodiment, if for example a person would like to move in the right direction, apparatus 10 increases thrust toward the right and that pushes the shoe along the water. In this case, for example, the jet motor 70 on the right side of the water shoe 20, 30 will actually move in a reverse motion to draw water into a jet stream within the water shoe 20, 30 while the jet motor 72 on the left side of the water shoe 20, 30 would rotate in the forward motion to eject the stream of water out of the water shoe 20, 30.

Figure 2:
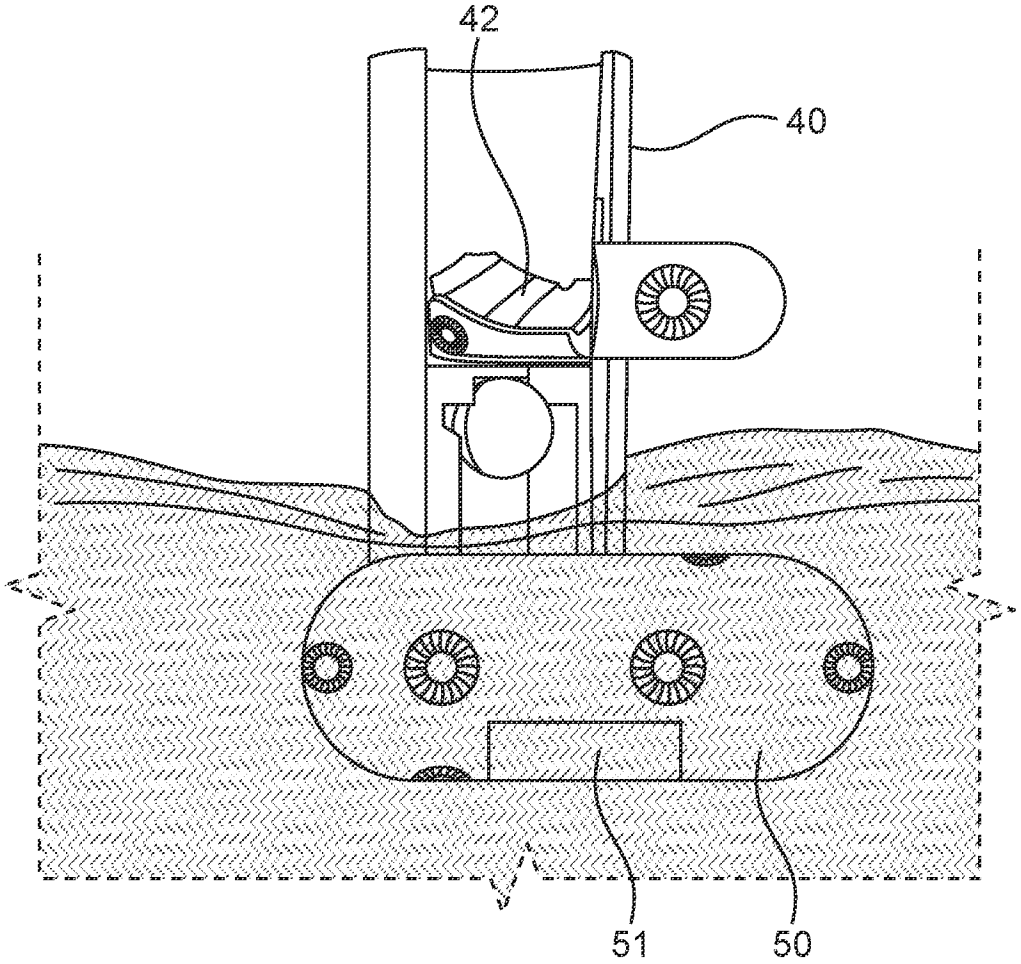
FIG. 2 is a side view of one water show with the bottom section immersed in water, in accordance with one embodiment.
Figure 3:
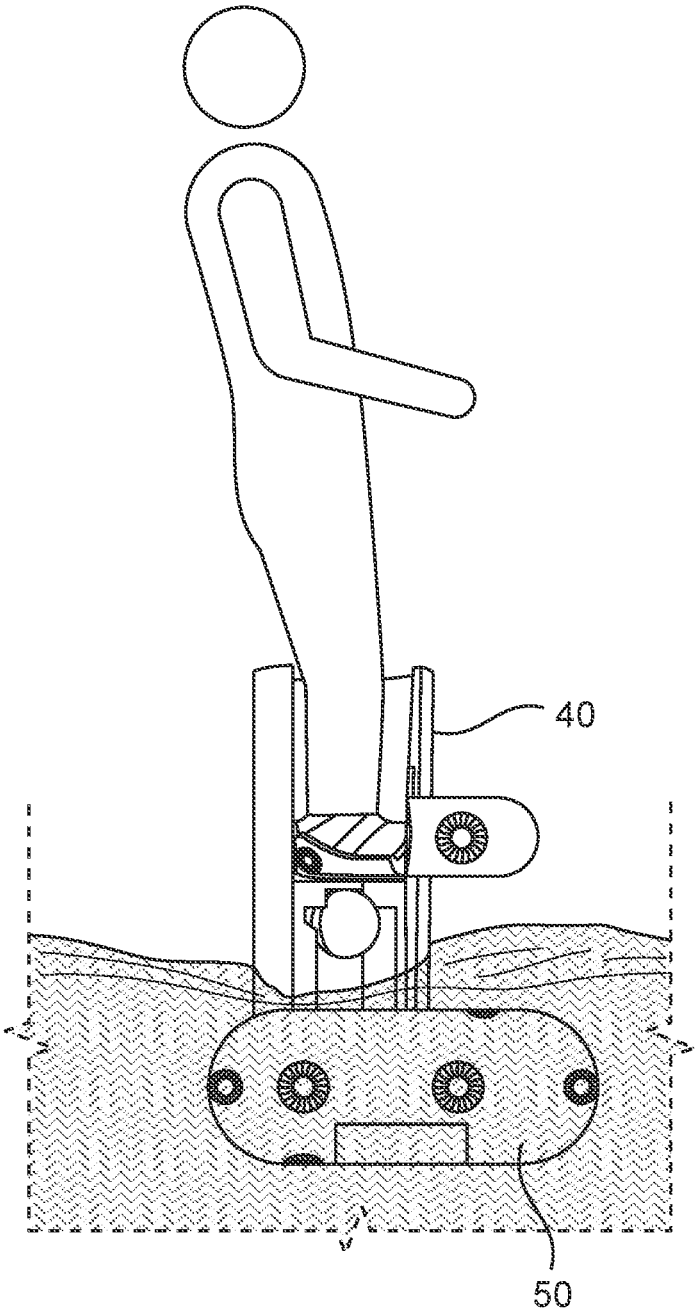
FIG. 3 a side view of a user standing on a platform within the vertical sleeve of a water shoe immersed in the water, in accordance with one embodiment.
Figure 4B:
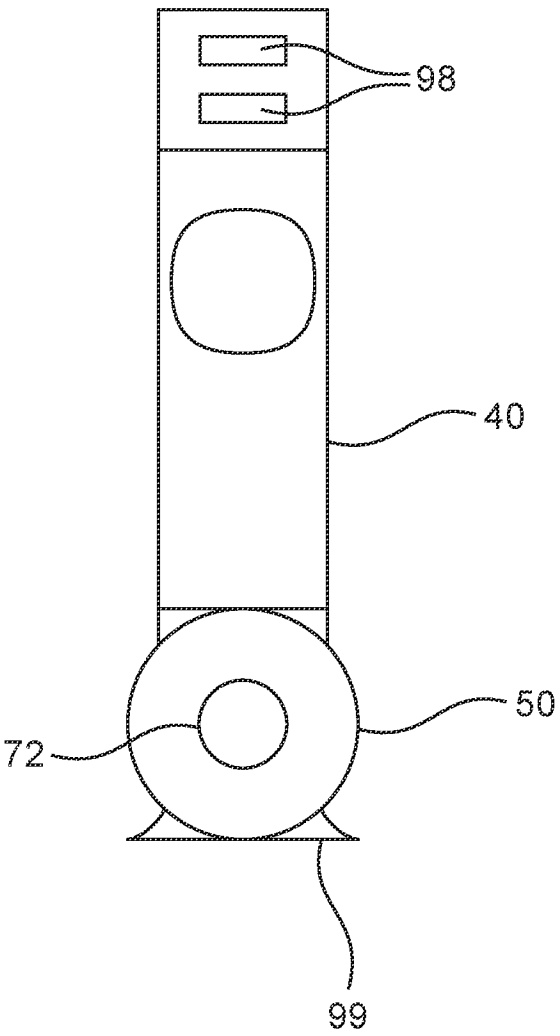
FIG. 4B is a front view of the water shoe of FIG. 4*a*, in accordance with one embodiment.
Figure 4A:
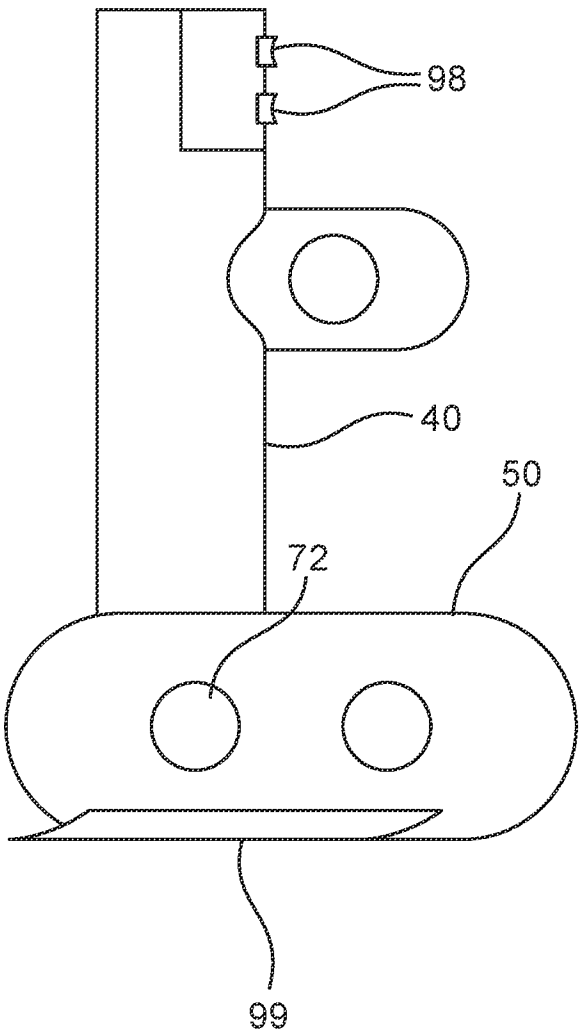
FIG. 4A is a side view of a water shoe, in accordance with one embodiment.
Figure 4E:
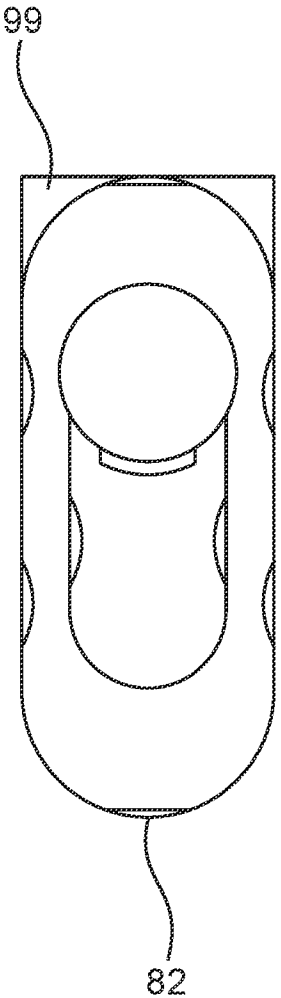
FIG. 4E is a plan view of the water shoe of FIG. 4*a*, in accordance with one embodiment.
Figure 4D:
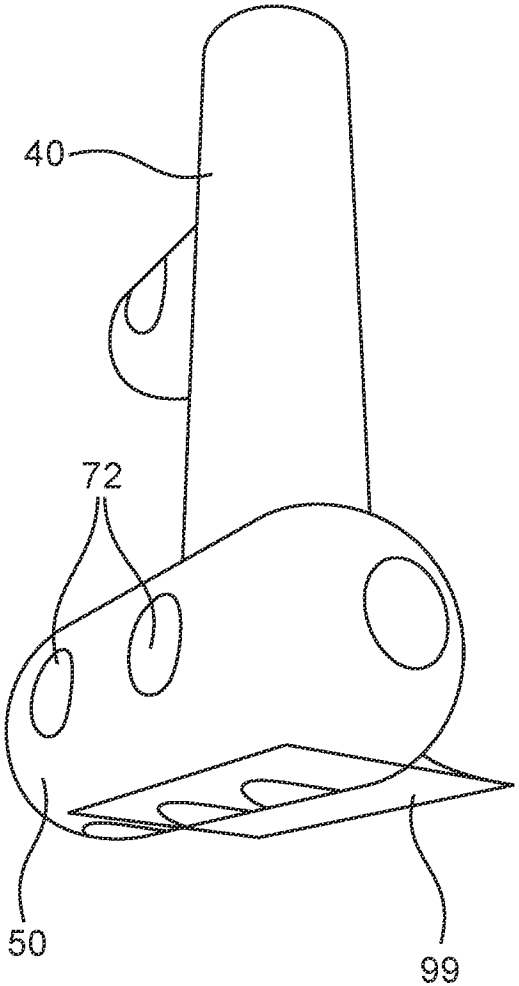
FIG. 4D is a side and rear perspective view of the water shoe of FIG. 4*a*, in accordance with one embodiment.
Figure 4C:
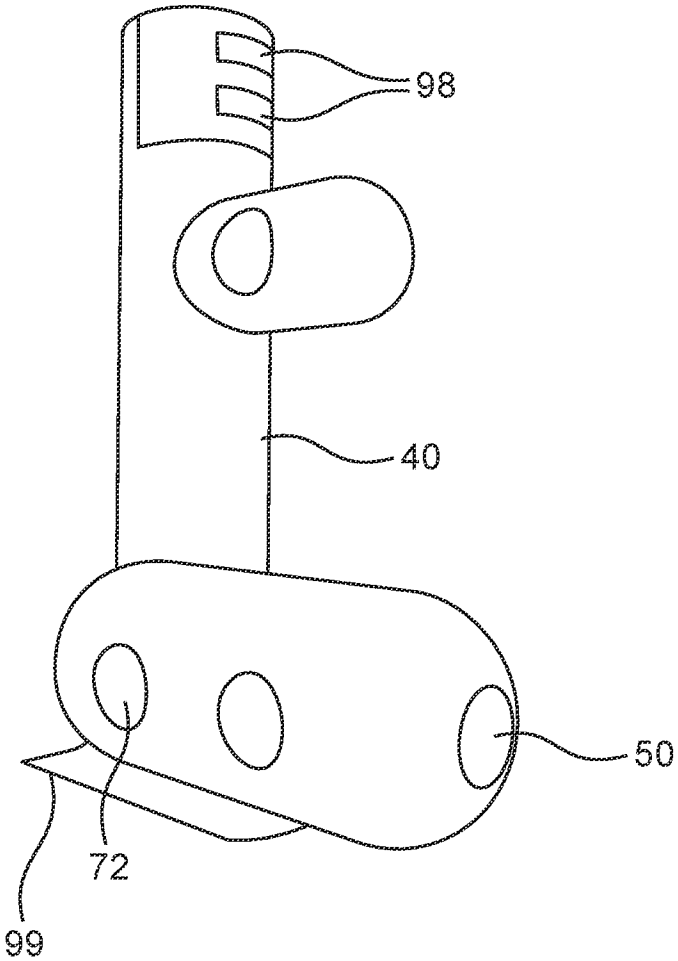
FIG. 4C is a side and front perspective view of the water shoe of FIG. 4*a*, in accordance with one embodiment.
Figure 5:
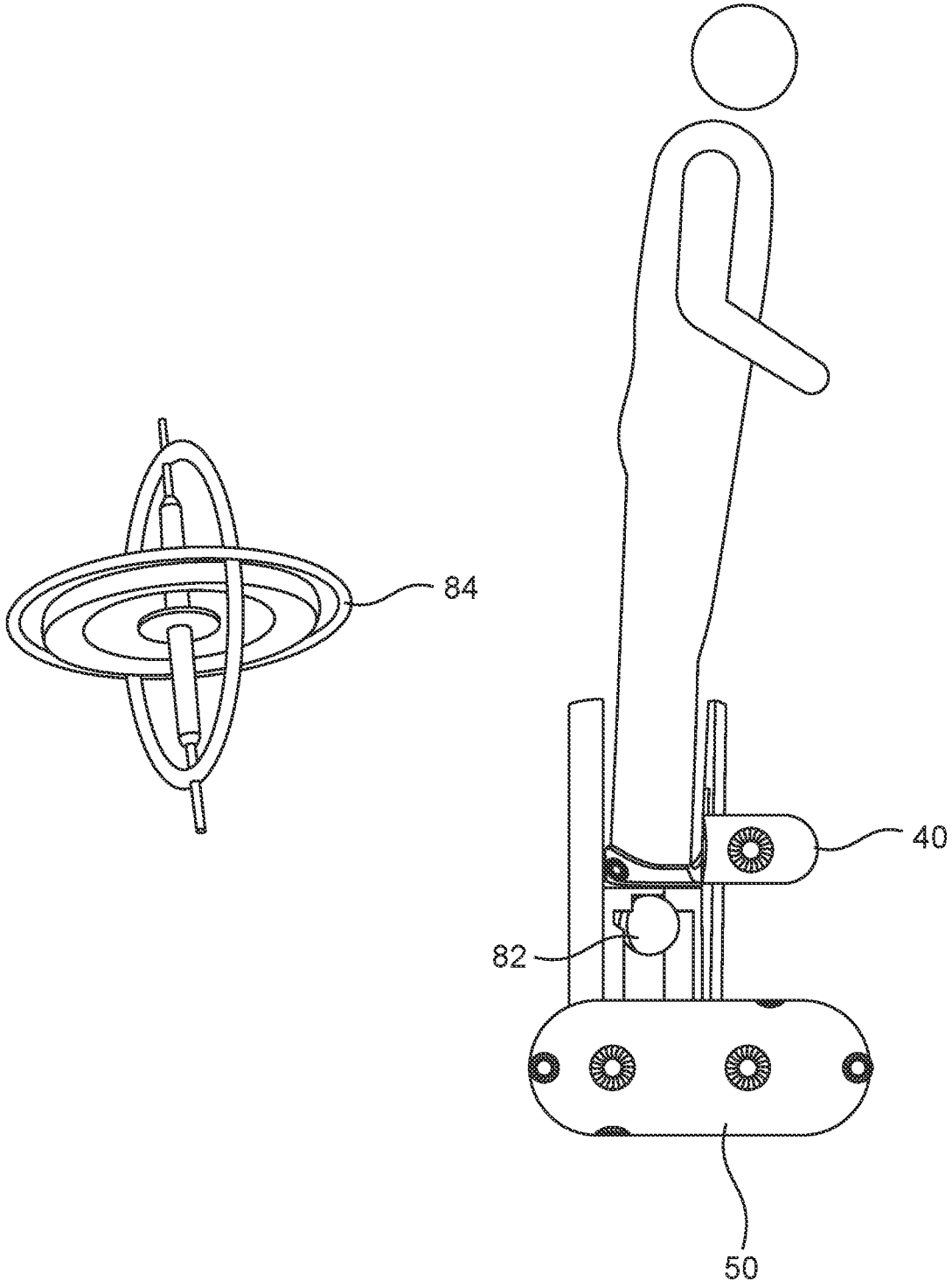
FIG. 5 is schematic view of a person standing on the water shoes with a gyroscope in the left background, in accordance with one embodiment.

As shown in FIG. 2, bottom section 50 of each shoe 20, 30 may include a buoyant material 51, for example foam 51, that resists the weight of the user causing undue sinking of water shoe 20, 30 into the water. In some embodiments, most of the weight of the user is absorbed by the bottom section of the shoe which has the buoyant material such as foam embedded within it. The foam also helps stabilize the weight of the person on the water. In one non-limiting example the foam 51 is foam closed-cell resin material known as Croslite® and used as the sole of Crocs® shoes.

As seen in FIG. 1, FIG. 2 and FIG. 6, platform 42 is disposed within the sleeve 40 substantially horizontally and may be offset vertically from bottom section 50. Sleeve 40 may include at least one pair of motors 71, 72 or at least one or two pairs of motors, for example motors 70 situated above platform 42.

In general, each of the water shoes 20, 30 are configured to be worn by a user simultaneously such that a movement of the user's legs may be used to trigger movement of water shoes 20, 30 in the indicated direction without use of a watercraft separate from the water shoe apparatus.

For example, processing unit 90 may be configured to direct at least one of the pairs of motors 71, 72, to eject a water stream, for example a jet stream, so as to adjust a pitch of the first water shoe 20 and of the second water shoe 30 (or in some cases of one of the two water shoes 20, 30). In this regard, processing unit 90 includes all hardware and software needed to implement this function and its other functions described herein.

As shown in FIG. 4 and FIG. 6, if the user wishes to move forward, the user may lean forward, for example 10 degrees forward on both feet such that the toes of shoes 20, 30 are positioned lower than the heels of shoes 20, 30. Leaning forward may cause a forward tilt of the first water shoe 20 and the second water shoe 30. This in turn may trigger a forward movement of the first water shoe 20 and second water shoe 30, for example as a result of water streams being ejected rearward and downward through jet motors situated on outer surface 52 of bottom section 50. Each jet motor that ejects water works in tandem with a parallel jet motor that draws water into water shoe 20, 30. In one non-limiting implementation, the jet motors that eject water rearward may be at a middle of a height of bottom section 50 and the jet motors that eject water downward may be at a floor or bottom of bottom section 50 as seen in FIG. 6.

In some embodiments, the activation of the jet motors may be triggered from a leaning movement of the user on adjustable platform 42. For example, platform 42 may comprise a soft foot pad. Platform 42 may have associated with it, pressure sensors, which may be configured to send a signal that moves the platform 42 depending on the rider's feet position. Leaning forward evokes one sensor reaction and leaning backward evokes another reaction. For example, in one embodiment, the user leaning forward causes the pressure sensor 42A connected to platform 42 to send a signal to the processing unit 90 to notify the processing unit 90 that the user wants to move forward so as to activate the jet motors appropriate for forward movement, as described.

Figure 7:
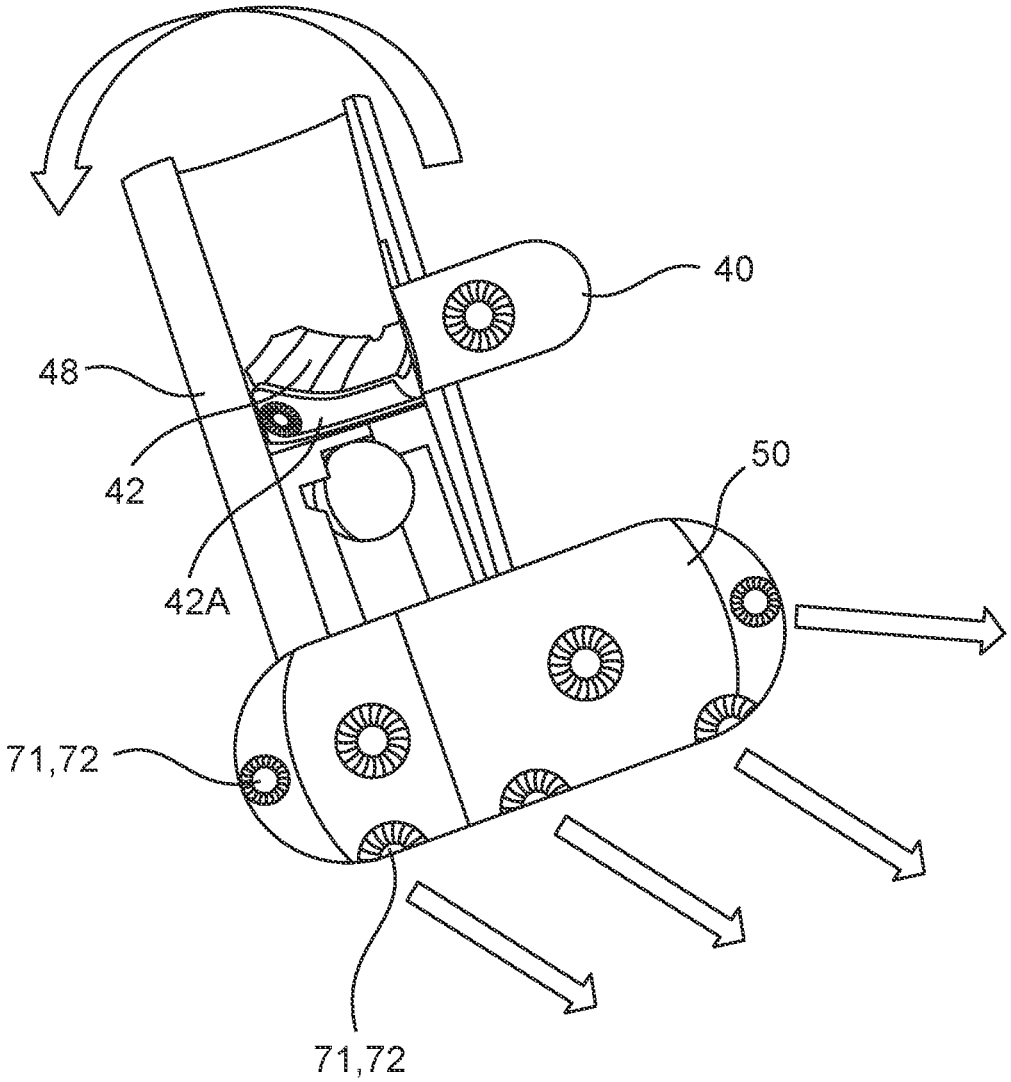
FIG. 7 is a side view of a water shoe depicting the direction of jet streams in the bottom section of the water shoe creating a forward thrust of water using jet motors, in accordance with one embodiment.

Similarly, as seen from FIG. 7, if the user wishes to move backward, the user may lean backward such that the toes of shoes 20, 30 are higher than the heels of shoes 20, 30. Leaning backward may cause a rearward tilt of the first water shoe 20 and of the second water shoe 30 and this may trigger a rearward movement of the first water shoe 20 and the second water shoe 30, for example by ejecting water stream forward and downward through jet motors situated on an outer surface 52 of bottom section 50. For example, in one embodiment, leaning backward may cause the pressure sensor 42A connected to the platform 42 to send a signal to the processing unit 90 to notify the processing unit 90 that the user wants to move backward so as to activate the jet motors of the jet stream mechanism appropriate for rearward movement, as described. In one non-limiting implementation, the jet motors that eject water forward may be at a middle of a height of bottom section 50 and the jet motors that eject water downward may be at a floor or bottom of bottom section 50 as seen in FIG. 7.

Figure 8:
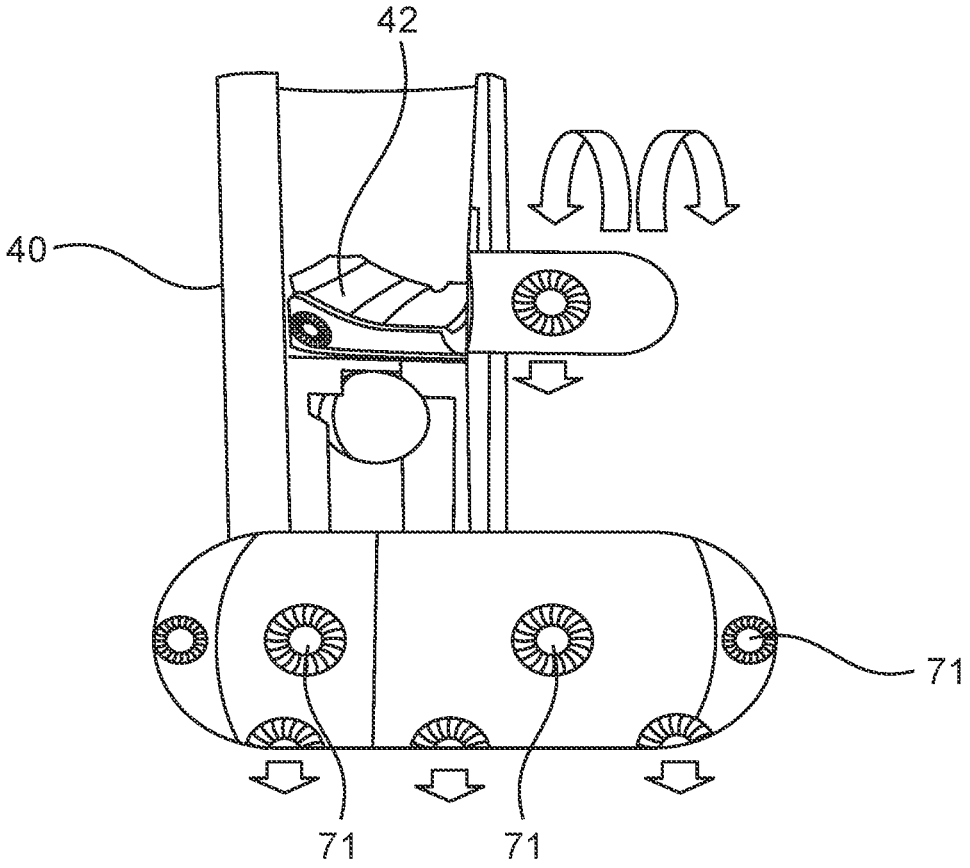
FIG. 8 is a side view of a water shoe depicting the direction of jet streams in the bottom section of the water shoe creating a sideward thrust using jet motors, in accordance with one embodiment.

As seen from FIG. 8, if the user wishes to move rightward, in some embodiments, this is triggered by jet motor(s) ejecting water streams leftward. If the user wishes to move leftward, in some embodiments this is triggered by jet motor(s) ejecting water streams rightward. Each jet motor 71, 72 that ejects a water stream works in tandem with a jet motor 71, 72 that draws a water stream into the water shoe 20, 30 and transfers the water stream toward the other jet motor 71, 72.

In one implementation of right and left movement, a forward tilt of the first water shoe 20 on the left foot of the user without the user moving the second water shoe (i.e. by keeping the second water shoe 30 straight) triggers a rightward turn of the water shoe apparatus 10, i.e. a rightward turn of the user wearing both water shoes 20, 30. Similarly, a forward tilt of the second water shoe 30 on the right foot of the user without the user moving the first water shoe (i.e. by keeping the first water shoe 20 straight) triggers a leftward turn of the water shoe apparatus 10 worn by the user including the left and right water shoes 20, 30. In another implementation, leftward movement of the user is triggered by tilting the platform/pedal leftward which signals the processing unit to direct at least one pair of motors to eject water streams rightward and rightward movement of the user is triggered by tilting the platform/pedal rightward which signals the processing unit to direct at least one pair of motors to eject water streams leftward.

In some embodiments, apparatus 10 further includes, in each of the shoes 20, 30, at least one pressure and water depth sensor for detecting a water depth of the shoe and for sending a signal of its output to the processing unit 90. If a threshold predetermined water depth is detected, processing unit 90 directs a motor to trigger a water stream ejection downward to resist further sinking and/or to elevate the water shoe 20, 30. In some embodiments, apparatus 10 also includes acceleration sensors 85 in each water shoe 20, 30.

Processing unit 90, in conjunction with stabilization unit 80 and jet stream mechanism 60, may also stabilize the water shoe 20, 30. For example, after processing unit 90 receives data from the stabilization unit 80, the data including the angle of the water shoe 20, 30, and in some embodiments data from one or more acceleration sensors 85 as to the acceleration of the water shoe 20, 30, processing unit 90 may direct one or more motors 70 to eject water streams to balance the orientation of water shoe 20, 30, for example to keep the shoe 20, 30 upright. In some cases, this may be independent of or unrelated to the directed of movement of the water shoe 20, 30. Accordingly, processing unit 90 includes software 91 stored on memory and configured to be executed on computer hardware so as to make any of the above calculations and determinations. Software 91 may comprise programmable instructions.

Accordingly, the processing unit 90 may control the overall speed of the water shoe apparatus 10, and of each individual water stream, the elements of the stabilization system 80 and the power of the apparatus 10.

Performing basic movements with the water shoe apparatus is very simple. Step on the water shoe and stand up straight. To move forward, slightly lean forward. To move backward slightly lean backward, placing more weight on the heels. To turn left, push the toes of your right foot/shoe 30 down. To turn right, push the toes of your left foot/shoe 20 down. The harder you press against the platform, the sharper the turn. With enough practice, the user will learn all of the steps.

To move forward, slightly lean forward. To move backward slightly lean backward, placing more weight on the heels. To turn left, push the toes of your right foot down. To turn right, push the toes of your left foot down. To perform a spinning maneuver, simply push down your toes on one foot and press your opposite foot's heels down.

When the user stands upright, the water shoe 20, 30 stops moving. This position is called dynamic stabilization. In general, with use of the water shoe apparatus 10, the user is kept afloat and stabilized at all times. As seen in FIG. 4*a* through FIG. 4*d*, in order to provide an additional stability, lower fins 99 project from a bottom of the shoes 20, 30. As seen from FIG. 4*a*, moreover, two hook elements 98 also project from an upper portion of sleeve 40 and are available for wrapping laces (not shown) that are configured to be tied so as to keep the sleeve 40 tight against the user's leg.

The two water shoes 20, 30 operate independently of one another. However, if the user lifts up the right foot that will naturally cause increased pressure on the left foot/shoe. So if the user lifts up the right foot, besides the fact that the right water shoe 30 sensors (tilt sensor, gyroscopes, acceleration sensors) will trigger jet streams so as to lift the right water shoe 30 to help the user walk forward, in addition, the additional pressure on the left water shoe 20 caused by putting greater weight on the left side of the body from lifting up the right leg, will also trigger the sensors (tilt sensor, gyroscopes, acceleration sensors) in the left water shoe 20 to signal processing unit 90 to trigger jet water streams being ejected from the left water shoe 20. This serves to create a sensation of walking on a hard surface.

For example, if the right foot is being lifted and moving forward the jets on the bottom and on the back of the shoe will power up to help the right shoe 30 lift up but simultaneously the left shoe 20, having experienced additional downward pressure from the extra weight on the left side of the user's body from lifting up the user's right leg, will react by powering up the jets on the bottom of the left shoe 20 in order to keep the left shoe 20 at the same water level (to avoid sinking) and thereby duplicate the sensation of walking on ground. When walking on the ground, even though there is pressure even though there is pressure against the ground, assuming the ground is rigid, one cannot sink into the pavement. Similarly, the jet streams on the side of the left shoe 20 will be used to keep the left shoe balanced and not sink downward from the extra weight. Stabilization system 80 will detect the up and down movement of the shoes 20, 30 and will determine orientation to balance the position and send corrections to the CPU and the CPU will send the command to the jets accordingly so it would give the person on the shoe 20 a sensation of walking on water similar to walking on the ground.

As stated, if a user standing in one place then tilts the left foot forward without any other movement on the right foot, this will result in a turn to the right. But if the left foot is being lifted it will result in a up and forward movement and if no other action will take place on the right foot the person might lose is balance just as if they walk on the ground by moving one foot forward and leaving the other foot at the same spot. Therefore, the development of locomotion skills between the two shoes 20, 30 is essential and in general, the user has to coordinate his or her legs because if for example only one leg were to tilt rightward, this would cause a dragging motion or falling off motion.

Figure 11:
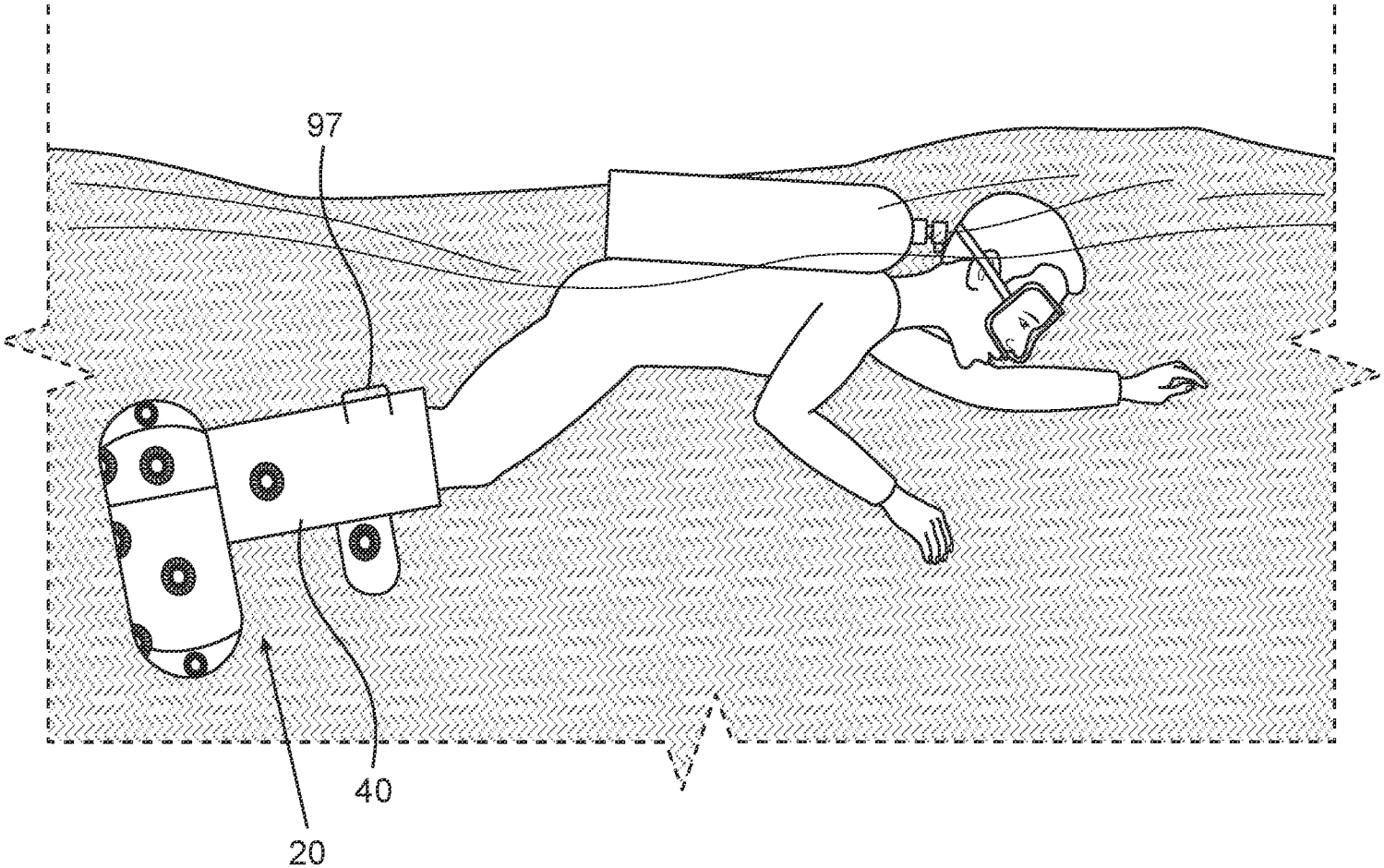
FIG. 11 is a photo of a person using the water shoe apparatus in scuba diving mode, in accordance with one embodiment.
Figure 12:
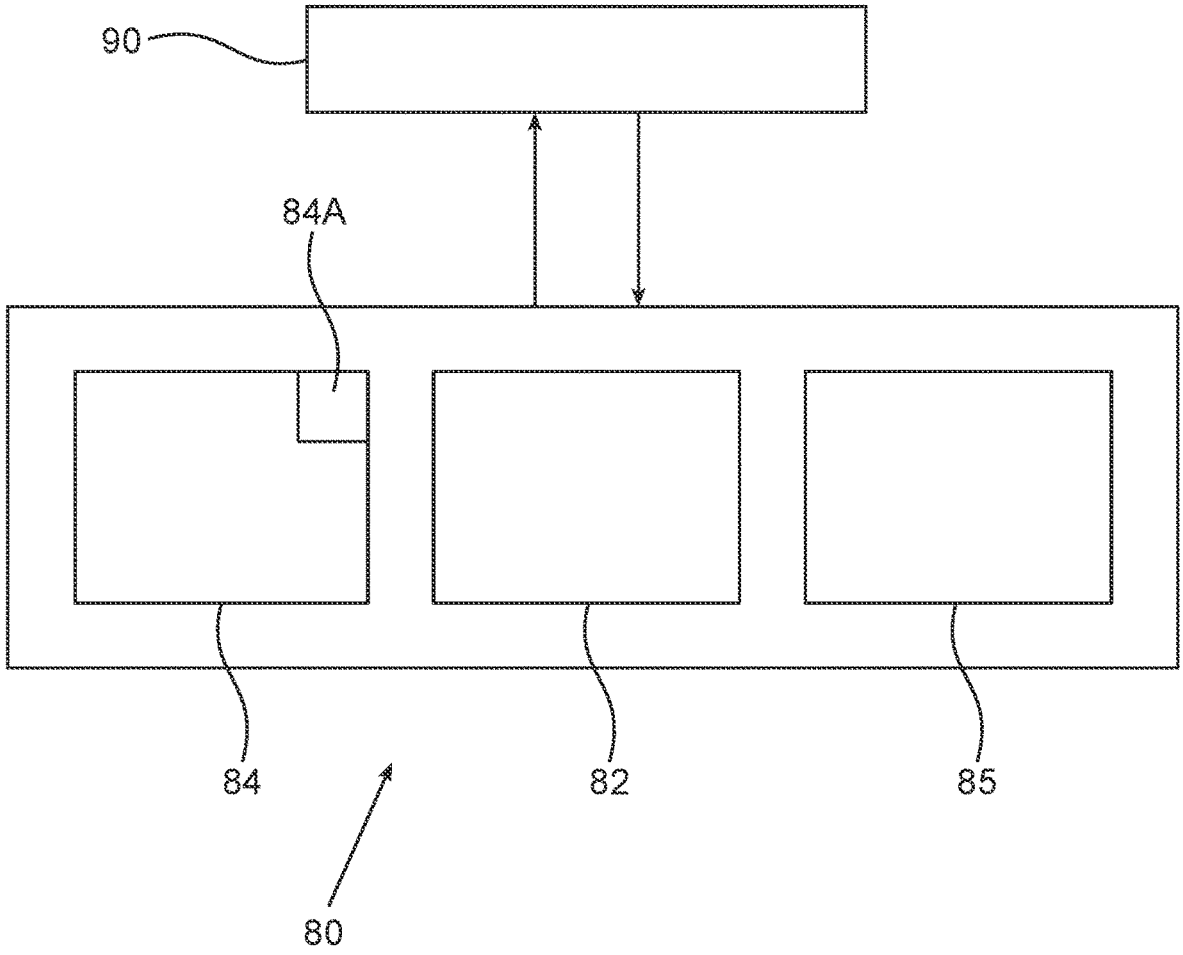
FIG. 12 is a schematic illustration of a stabilization unit, in accordance with one embodiment.

Water shoe apparatus 10, in certain embodiments, also has an input mechanism 97 such as a switch 97 on sleeve 40 of either water shoe 20, 30 that is accessible to the user and that controls a status of ("Off" or "On") the stabilization unit 80 of both shoes 20, 30 (including the gyroscopes 84 and tilt sensor 82) and jet stream mechanism 60 that stabilizes water shoes 20, 30. In some embodiments, switch 97 controls the stabilization unit 80 of both shoes 20, 30 (for example by making use of a short range communication protocol such as BlueTooth® that is activated by switch 97 or by processing unit 90 being configured to communicate (for example by short range communication protocol) with its counterpart in the other water shoe 20, 30 when it receives a directive to shut down stabilization unit 80). As shown in FIG. 11, when that input mechanism 97 has been activated by the user, the apparatus 10 is in scuba diving mode and can be used for snorkeling. Consequently, even though, according to certain embodiments, when using water shoe apparatus 10, remote control devices are not needed, if the scuba diving mode is active, the user may choose to snorkel with a remote-control device operated by the user's hand(s).

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A wearable water shoe apparatus for walking, standing and jet skiing on water, comprising:

each of a first water shoe and a second water shoe comprising:

(i) a sleeve configured to receive a leg of a user and (ii) a bottom section integrally attached to the sleeve, the sleeve having a platform for standing thereon, a processing unit, a plurality of pairs of jet motors, each of the pairs of jet motors situated at different positions along an outer surface of either the bottom section or the sleeve, a stabilization unit comprising a tilt sensor and a plurality of gyroscopes, the stabilization unit configured to detect a stabilization state for the first water shoe or the second water shoe, the processing unit configured to receive an output from the stabilization unit, determine a direction of movement indicated by the user and direct at least one of the pairs of jet motors to eject a water stream out of at least one of the first water shoe and the second water shoe based on the direction of movement indicated.

2. The wearable water shoe apparatus of claim 1, wherein, for the first water shoe, each of the pairs of jet motors includes a first jet motor configured to draw a stream of water into the first water shoe and thrust the stream of water toward a second jet motor, working in tandem with the first jet motor, the second jet motor configured to eject the stream of water out of the first water shoe.

3. The wearable water shoe apparatus of claim 1, wherein each of the plurality of pairs of jet motors in the water shoe include a first jet motor configured to rotate in a first direction so as to draw a stream of water into the first water shoe and a second jet motor configured to eject the stream of water from the first water shoe, the first jet motor and the second jet motor of each pair situated at parallel positions along an outer surface of either the bottom section or the sleeve of the first water shoe.

4. The wearable water shoe apparatus of claim 1, wherein, for each water shoe, the bottom section has at least three pairs of jet motors and the sleeve has at least one pair of jet motors.

5. The wearable water shoe apparatus of claim 1, wherein, for each water shoe, the bottom section has at least two pairs of jet motors and the sleeve has at least one pair of jet motors.

6. The wearable water shoe apparatus of claim 1, wherein the sleeve has at least one of the plurality of pairs of jet motors situated above the platform.

7. The wearable water shoe apparatus of claim 1, wherein the platform is disposed within the sleeve substantially horizontally and is offset vertically from the bottom section.

8. The wearable water shoe apparatus of claim 1, further comprising at least one sensor for detecting a water depth of the shoe and for sending a signal to the processing unit.

9. The wearable water shoe apparatus of claim 1, wherein at least part of the bottom section includes a buoyant material.

10. The wearable water shoe apparatus of claim 1, wherein the stabilization state includes an angle that the first water shoe or second water shoe makes with a surface of the water.

11. The wearable water shoe apparatus of claim 1, wherein the plurality of gyroscopes includes at least five gyroscopes configured to correct the stabilization state more than twenty times per second.

12. The wearable water shoe apparatus of claim 1, further comprising acceleration sensors in each water shoe of the wearable water shoe apparatus.

13. The wearable water shoe apparatus of claim 1, wherein each of the first water shoe and the second water shoe is configured to be worn by a user simultaneously such that a movement of legs of the user triggers movement of the water shoes in the direction of movement indicated without use of a watercraft separate from the wearable water shoe apparatus.

14. The wearable water shoe apparatus of claim 1, wherein the processing unit is configured to direct the at least one of the pairs of jet motors to eject the water stream in response to an adjustment by the user of a pitch of at least one of the first water shoe and the second water shoe.

15. The wearable water shoe apparatus of claim 1, wherein a user leaning forward to cause a forward tilt of the first water shoe and the second water shoe triggers a forward movement of the first and second water shoes by ejecting water stream rearward and downward, and wherein leaning backward so as to cause a rearward tilt of the first water shoe and the second water shoe triggers a rearward movement of the first and second water shoes by ejecting water stream forward and downward.

16. The wearable water shoe apparatus of claim 1, wherein a forward tilt of the first water shoe on the left foot of the user without the user moving the second water shoe triggers a rightward turn of the wearable water shoe apparatus and wherein a forward tilt of the second water shoe on the right foot of the user without the user moving the first water shoe triggers a leftward turn of the wearable water shoe apparatus.

17. The wearable water shoe apparatus of claim 1, wherein leftward movement of the user is triggered by tilting the platform leftward which signals the processing unit to direct at least one pair of motors to eject water streams rightward.

18. The wearable water shoe apparatus of claim 1, wherein rightward movement of the user is triggered by tilting the platform rightward which signals the processing unit to direct at least one pair of motors to eject water streams leftward.

19. The wearable water shoe apparatus of claim 1, further comprising a switch accessible to the user for turning off the stabilization unit for use of the wearable water shoe apparatus in a scuba diving mode.

* * * * *